United States Patent [19]

Havins, Sr.

[11] Patent Number: 4,723,500

[45] Date of Patent: Feb. 9, 1988

[54] BOAT STEERING CONTROL SYSTEM

[76] Inventor: Felton H. Havins, Sr., 300 NE. 6th St., Fort Worth, Tex. 76106

[21] Appl. No.: 853,203

[22] Filed: Apr. 17, 1986

[51] Int. Cl.[4] ..... B63H 25/00

[52] U.S. Cl. ..... 114/144 E; 440/7; 440/58

[58] Field of Search ..... 440/6, 7; 74/478, 480 B, 74/481, 512, 560; 114/144 R, 144 RE

[56] References Cited

U.S. PATENT DOCUMENTS 3,807,345 4/1974 Peterson ..... 440/7

4,527,983 7/1985 Booth ..... 440/7

*Primary Examiner*—Sherman D. Basinger

*Assistant Examiner*—Jesûs D. Sotelo

*Attorney, Agent, or Firm*—James C. Fails; Wm. T. Wofford; Arthur F. Zobal

[57] ABSTRACT

There is disclosed a steering control system for a boat propelled by either bow mounted or transom mounted trolling motors. The steering control system includes a steering cam assembly, actuating device for imparting relative rotational movement between the steering cam and the steering cam housing, and steering device for turning the trolling motors in a manner responsive to the actuation of the switching device. The steering cam assembly has a steering cam with actuating surfaces that form varying contours, a steering cam housing that houses the steering cam such that the steering cam rotates relative to the steering cam housing, electrical switching device coupled to the steering cam housing with actuation portions responsive to the actuating surfaces. Several different embodiments of the steering device are provided that either swing the trolling motors in an arc or rotate the trolling motors.

15 Claims, 13 Drawing Figures

159
M
167
M
185
181
187
203
183
205
209
207
201
201
195
195
197
197
199
199
191
193
189
107
105
39

BOAT STEERING CONTROL SYSTEM

FIELD OF THE INVENTION

The present invention relates to control systems for steering self-propelled watercraft, particularly those types of watercraft that are used for recreational purposes.

BACKGROUND OF THE INVENTION

Fishing boats commonly come equipped with secondary propulsion means that supplement the primary or main propulsion motor. The secondary propulsion means propels the boat more quietly and at a much lower speed than the noisy internal combustion main motor. The secondary propulsion means includes one or more submergible portions, which provide propulsive thrust, and mounting portions for mounting each submergible portion to the boat.

Typically the secondary propulsion means submergible portion includes an electric trolling motor, and the mounting portion includes a mounting bracket. The trolling motor depends from a vertical shaft which is coupled to the boat by the mounting bracket. The vertical shaft is supported by the mounting bracket in such a way that rotation of the shaft around its vertical or longitudinal axis is permitted.

A prior art steering control for trolling motors commonly in use consists of a short horizontal steering bar coupled to the vertical shaft in such a manner that the steering bar extends inwardly towards the boat. Steering is accomplished by moving the steering bar from side to side causing the vertical shaft to rotate around its longitudinal axis and turn the trolling motor to change the direction of propulsive thrust.

On fishing boats having pedestal mounted seats in the bow and stern areas, the steering bar is located inconveniently far away from the seats. In addition, the steering bar is most effectively operated by hand. Thus, the inconvenience becomes even greater because the fisherman is using both of his hands to cast and to reel as the boat is slowly propelled through the water. To steer the boat while fishing, the fisherman must stop casting and reeling, and lean over to the steering controls.

Another type of steering control in the prior art allows steering from a position that is remote from the trolling motor. The steering control consists of a foot pedal mounted on a fulcrum that enables the pedal to rock back and forth in a seesaw-like fashion, and steering means responsive to the actuations of the foot pedal and for rotating the trolling motor. Actuating the pedal may result in discomfort or even pain to the foot.

It is an objective of the present invention to provide a steering control system for a boat that may be operated without the use of the hands.

Another objective of the present invention is to provide a steering control system with controls that may be located on a boat in a position that makes operation convenient.

DESCRIPTION OF PREFERRED EMBODIMENTS

Figure 1A:
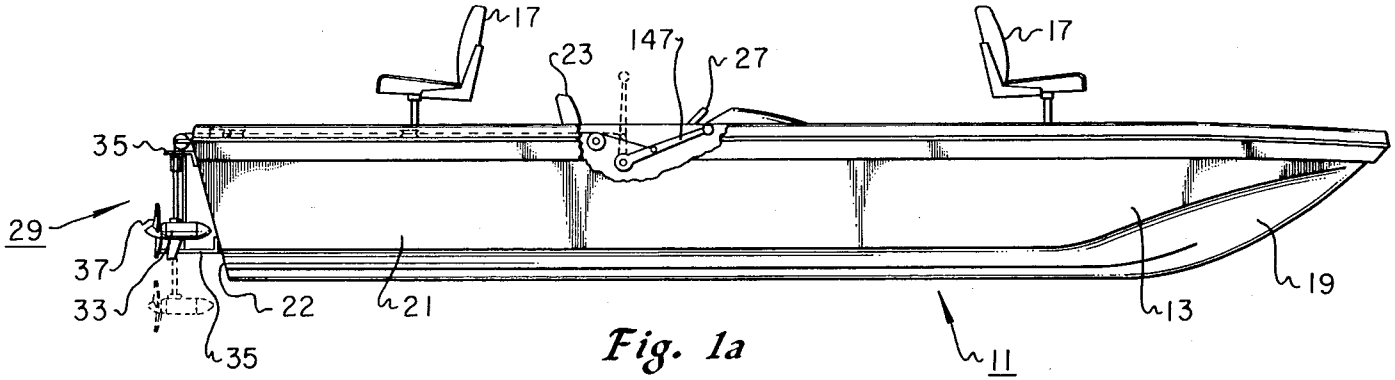
FIG. 1*a* is a schematic side view showing a fishing boat incorporating an installation of apparatus for raising and lowering trolling motors, in accordance with a preferred embodiment.
Figure 1B:
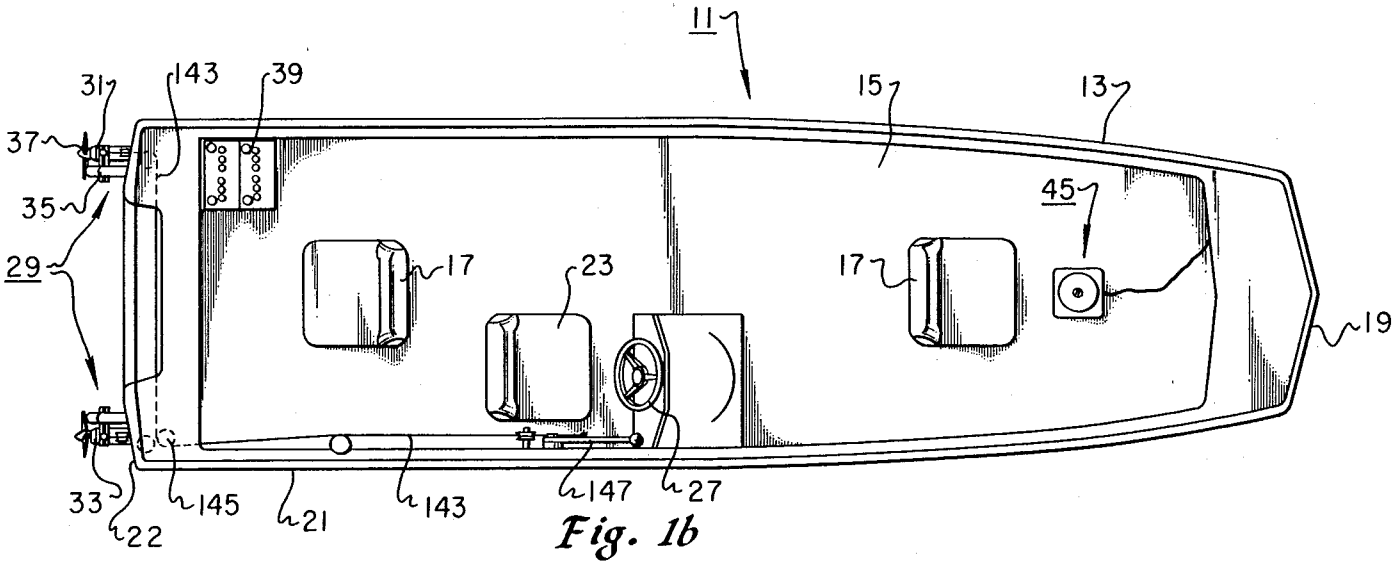
FIG. 1*b* is a schematic plan view of the boat of FIG. 1*a* incorporating an installation of the steering control system of the present invention, in accordance with a preferred embodiment.

In FIGS. 1*a* and 1*b* there are shown side and plan views of a typical fishing boat 11 in which a steering control system of the present invention, in accordance with a preferred embodiment, has been installed. There is shown the boat hull 13 and the boat deck 15. Fishing seats 17, mounted on pedestals several feet off of the deck 15 and capable of rotating 360°, are located in the bow and stern portions 19, 21, of the boat. The boat is equipped with primary and secondary propulsion means. The primary propulsion means is typically a large internal combustion engine (not shown) located on the transom 22 of the boat. The primary engine may be either an outboard type or an inboard type, although in a boat such as is illustrated, an outboard engine would be the type most commonly used. A driver's seat 23 is mounted to the deck 15 on the right or starboard side of the boat 11. Throttle and directional controls 25, 27 for the primary engine are accessible from the driver's seat 23.

The secondary propulsion means 29 is electrical in nature and includes portions 31, 33 that are submergible and thus can operate in an underwater environment, and mounting portions 35. In the illustrated embodiment, the submergible portions are left and right hand trolling motors 31, 33 and the mounting portions are mounting brackets 35. The trolling motors 31, 33 have a streamlined shape so as to present a minimal amount of resistance to the water as the trolling motors travel through the water. A propeller 37 provides propulsive thrust in a direction coaxial to the longitudinal axis of each trolling motor. The trolling motors are fixed to the transom 22 of the boat hull 13 by the mounting brackets 35. In order to simplify steering, there are an equal number of trolling motors on each side of the boat keel and the trolling motors are located equal distances from the keel.

The boat also has means for energizing the electrical systems on board including the trolling motors and steering control system. In the preferred embodiment, the means for energizing the electrical systems is one or more batteries 39.

The steering control system of the present invention in accordance with a preferred embodiment, with reference to FIGS. 2–7, will now be described. This embodiment is sometimes hereinafter referred to as the swing arm embodiment. The steering control system may be said to include a steering cam assembly 45, actuating means 47, and steering means 49 for changing the orientation of the trolling motors relative to the boat hull.

Figure 3:
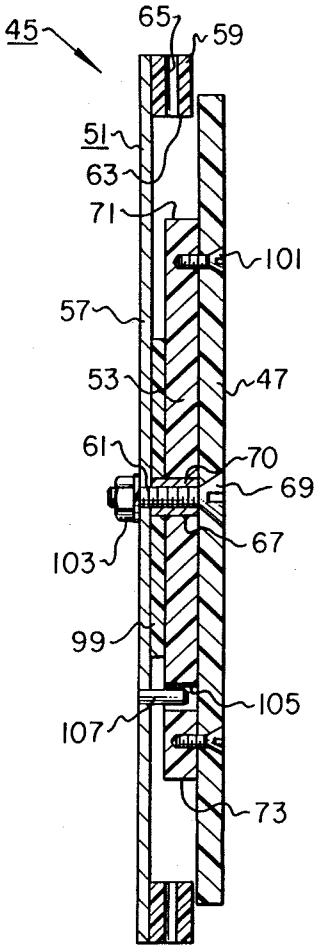
FIG. 3 is a schematic vertical section view of FIG. 2 taken at lines III—III.
Figure 2:
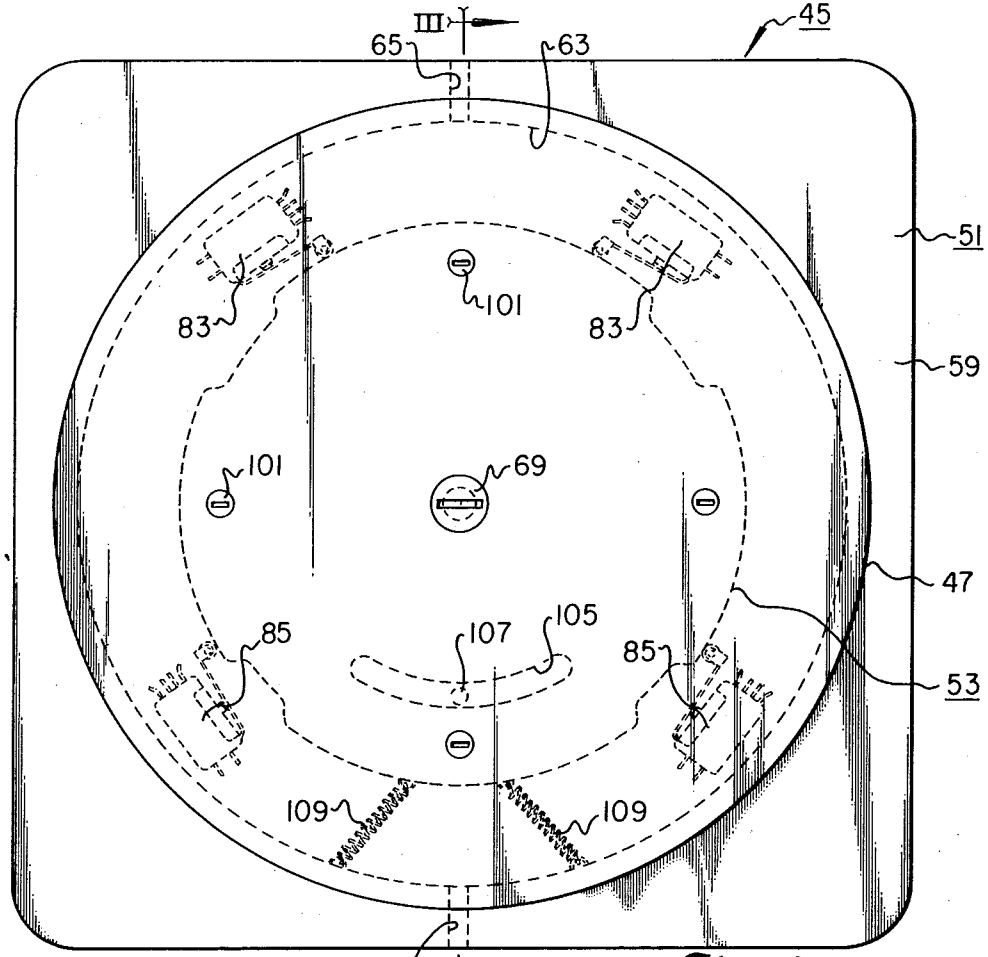
FIG. 2 is a schematic plan view of the steering cam assembly.
Figure 4:
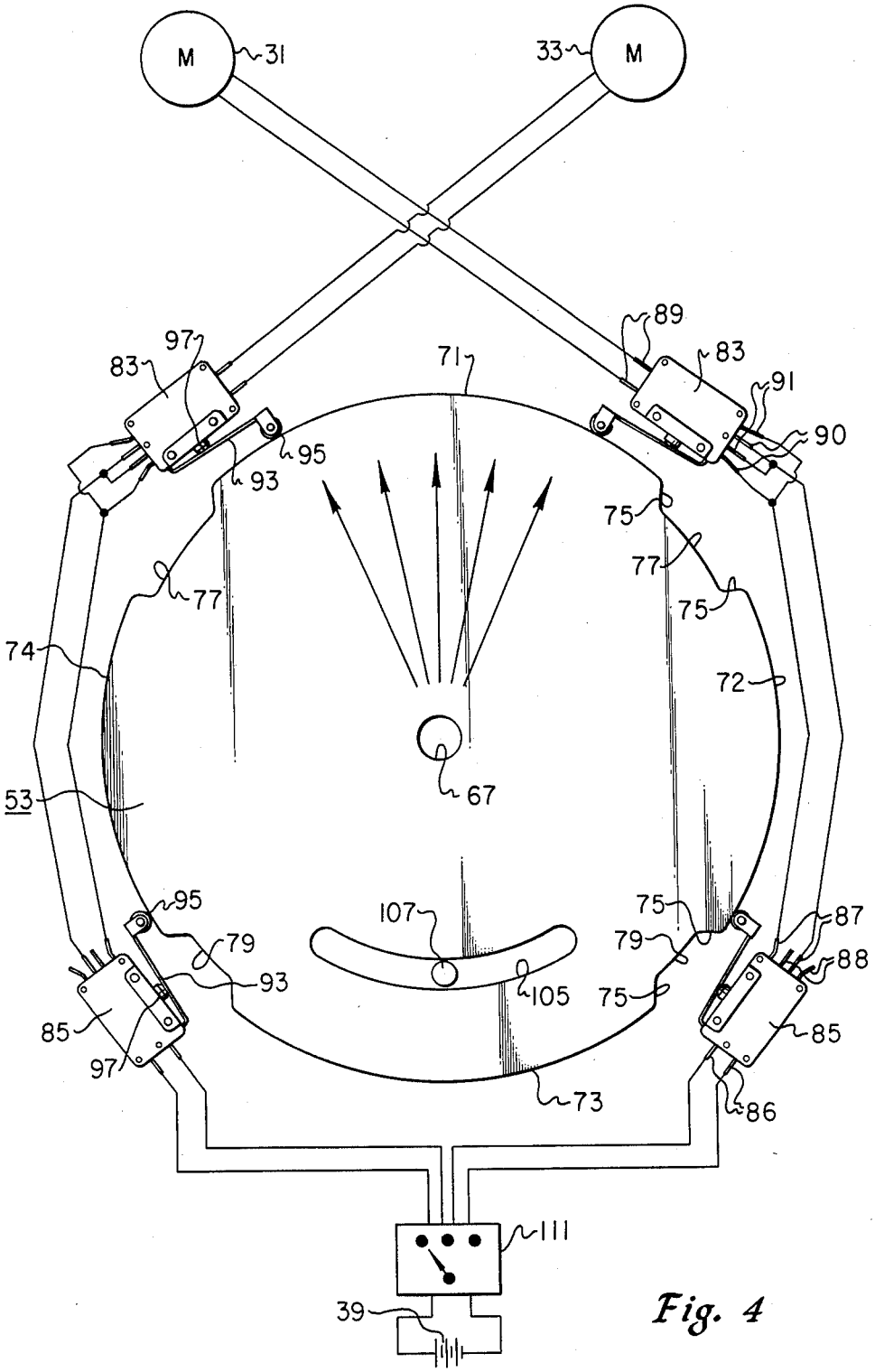
FIG. 4 is an electrical schematic view of the steering control system of the present invention, in accordance with a preferred embodiment.

The steering cam assembly 45 includes first and second members and electrical switching means (see FIGS. 2 and 3). In the preferred embodiments, the first and second members are a steering cam 53 and a steering cam housing 51, respectively. The steering cam housing 51 has a thin bottom plate 57 and a thicker center plate 59 of equal circumferential dimensions. Both plates are penetrated by circular holes that are centrally located; the bottom plate has a small hole 61 for receiving a bolt 69 and the center plate has a much larger hole 63 for the creation of a cylindrical cavity. The cylindrical cavity, having the bottom plate 57 as a bottom wall and the center plate 59 as a side wall, is formed when the center plate is affixed to the bottom plate by screws (not shown) such that the two holes, 61, 63 are coaxial. The cavity is of suitable depth and width to receive the generally cylindrical steering cam 53 and the electrical switching means. Small transverse wireways 65 in the center plate 59 allow communication between the cavity and the outside of the steering cam housing. The steering cam 53 has a centrally placed hole 67 extending therethrough for receiving the bolt 69 and a bushing 70. The circumference of the steering cam 53 has actuating surfaces that form varying contours. Referring now in particular to FIG. 4, it can be seen that the actuating surfaces fall into two general catagories of non-indented surfaces and indented surfaces. The non-idented surfaces are the circumferential surfaces 71, 72, 73, and 74 normally found on a cylindrical object. These circumferential surfaces are not continuous with one another however, as in the case of a cylinder, because of the indented surfaces that are interposed therebetween. Thus, there are first, second, third, and fourth circumferential surfaces 71, 72, 73 and 74. The indented surfaces include transitional surfaces 75, polarity control surfaces 77, and magnitude control surfaces 79. Each end of the circumferential surfaces 71, 72, 73, and 74 merge with the transitional surfaces 75 which in turn then merge with either a polarity control surface 77 or a magnitude control surface 79. In order to provide for the control of the magnitude of the trolling motors, there is provided a magnitude control surface 79 for each side of the boat. Thus there is a left hand magnitude control surface and a right hand magnitude control surface. The same provision is made for the polarity control surfaces 77.

The electrical switching means include, in the preferred embodiments, commercially available conventional switch packages, 83, 85 wired together in such a manner so as to control the energy provided to the individual trolling motors 31, 33. Each switch package has two single-pole, double-throw switches located inside (not shown), the associated electrical contacts and an actuating portion. The magnitude switch packages 85 have a common contact 86, a first contact 87, and a second contact 88 for each switch. The common contact 86 alternates in being connected to either the first contact 87 or the second contact 88. The actuating portion includes an arm 93 that is attached to the switch package at one end and has a roller 95 at the other end. The arm 93 pivots in and out from the switch package about its attached end alternately depressing and releasing a spring loaded button 97. As the arm 93 releases the button 97, both of the switches inside of the switch package are thrown from the set of first contacts 87 to the set of second contacts 88. This action breaks the connection between the common contacts 86 and the first contacts 87 and makes the connection between the common contacts 86 and the second contacts 88. The polarity switch packages 83 also have sets of common contacts 89, first contacts 90, and second contacts 91. A switch package is provided for each of the polarity control surfaces and the magnitude control surfaces. Therefore, there are two polarity control switch packages 83 and two magnitude switch packages 85.

To assemble the steering cam assembly 45 of the swing arm embodiment of the present invention, the steering cam 53 is placed inside of the cavity of the steering cam housing 51, atop a large flat washer 99 which acts as a flat bearing such that the steering cam hole 67 is aligned with the bottom plate hole 61 (see FIGS. 2 and 3). The cylindrical bushing 71 is then inserted into the steering cam hole 67 and the washer 99. Next the switch packages 83, 85 are affixed to the steering cam housing bottom plate 57 by conventional methods after being positioned inside of the cavity and adjacent to the steering cam 53 such that the switch package rollers 95 contact the steering cam circumferential surfaces 71, 72, 74 as shown in FIG. 2 and the arms 93 depress the respective buttons 97. The switch packages 83, 85 are, however, placed sufficiently far away from the steering cam 53 so that as the steering cam is rotated and the rollers contact the control surfaces 77, 79, the arms 93 release the buttons 97. The positioning of the rollers on the appropriate circumferential surfaces determines the sequencing of control signals derived from the battery supply and as applied to the individual trolling motors. The rollers 95 for the two polarity switch packages 83 are located on the first circumferential surface 71 which lies between the polarity control surfaces 77. The rollers for the two magnitude switch packages 85 are located on the second and fourth circumferential surfaces 72, 74. Also, the distance between the rollers of the magnitude switch packages 85 and the magnitude control surfaces 79 is less than the distance between the rollers of the polarity switch packages 83 and the polarity control surfaces 77. These distances insure that as the steering cam 53 is rotated, a magnitude switch package 85 will actuate before a polarity switch package 83. The switch packages are wired together in a configuration to be described in greater detail hereinafter. The wires are then passed through the appropriate wireways 65.

In addition to the components listed above, there is provided actuating means for imparting relative rotational movement between the steering cam 53 and the steering cam housing 51, which in the preferred embodiments, is a top plate 47 of circular dimension. The top plate 47, which has a centrally located bore for receiving the bolt, is large enough to cover the open end of the cavity of the steering cam housing 51 and is coupled to the top surface of the steering cam 53 by screws 101. As a final step to assembling the steering cam assembly 45, the bolt 69 is inserted into the central hole of the top plate 47 and into the bushing 70, and is then secured with a nut 103 on the bottom surface of the bottom plate 57. The steering cam 53 is unitary with the top plate 47 and thus rotates whenever the top plate is turned.

The steering cam assembly is provided means for limiting the relative rotational distance traversed between the steering cam 53 and the steering cam housing 51 to a predetermined angular range,which in the preferred embodiments include a groove 105 in the bottom surface of the steering cam and a peg 107 extending upwardly from the bottom plate into the groove (see FIGS. 2 and 3). The groove 105 having the shape of a circular arc, is concentrically located on the steering cam so that as the steering cam is rotated, the peg 107 stays within the groove. The arcuate length of the groove 105 is determined by the rotational limitation desired. In the preferred embodiments, the groove 105 is short enough to prevent the switch package rollers 95 from engaging any unintended control surfaces 77, 79. Since the steering cam 53 is meant to turn both clockwise and counter-clockwise, the peg 107 should be centered between the two ends of the groove 105 when the steering cam is positioned to steer straight ahead.

The steering cam assembly is further provided a means for realigning the steering cam 53 relative to the steering cam housing 51 to a pre-actuation alignment, after the top plate 47 has been actuated. The pre-actuation alignment is the alignment of the steering cam 53 that steers the boat straight ahead. In the preferred embodiments, the realignment means includes a springs 109 having one end attached to the center plate 59 and the other end attached to the steering cam 53. The spring 109 is of a short enough length so that any rotation of the steering cam from the pre-actuation alignment will stretch the spring.

Referring to FIG. 4, the electrical configuration will now be discussed. A conventional three position switch 111 (ON-OFF-REVERSE) controls the magnitude and polarity of the energy supplied by the battery 39 to both trolling motors 31, 33 simultaneously, while the switch packages 83, 85 control the magnitude and polarity of the energy supplied by the battery to the trolling motors individually. The outputs from the three position switch 111 are connected to the common contacts 86 of the respective magnitude switch packages 85. As viewed in FIG. 4, the right hand polarity switch package and the right hand magnitude switch package control the left hand trolling motor 31. Likewise, the left hand switch packages control the right hand trolling motor 33. Since the left hand connections are a mirror image of the right hand connections, only the right hand connections will be discussed. The first contact 87 from each switch of the magnitude switch package 85 is then connected to a first contact of one switch of the polarity switch package 83 and also to a second contact of the other switch inside of the polarity switch package. Then, the common contacts 89 of the polarity switch package 83 are connected to the left hand trolling motor 31.

Figure 5:
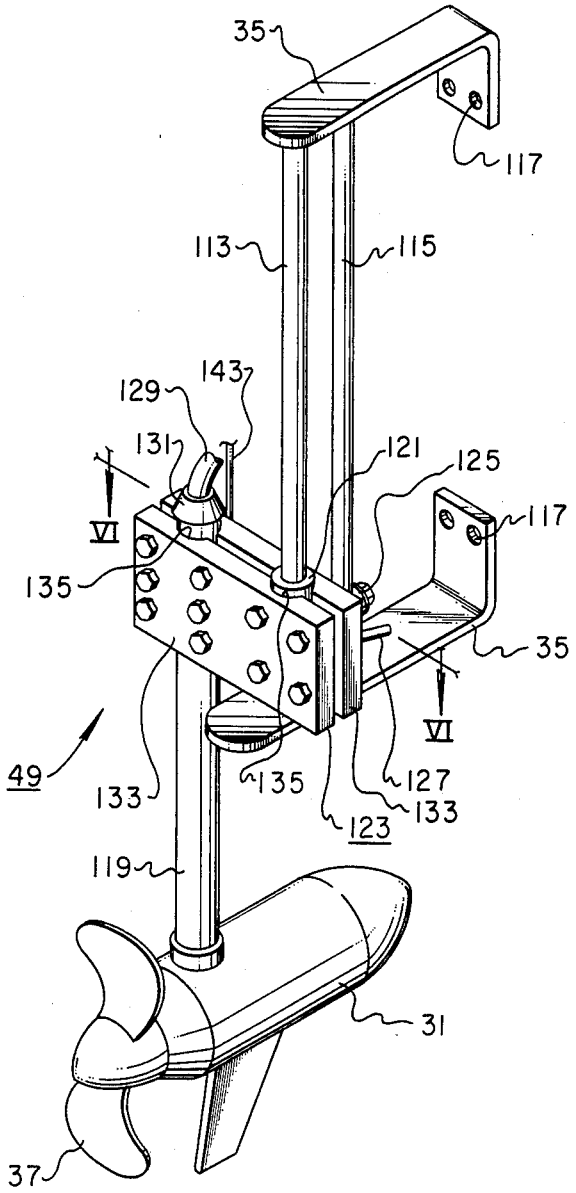
FIG. 5 is a schematic isometric view of a trolling motor and steering means in accordance with a preferred embodiment.
Figure 7:
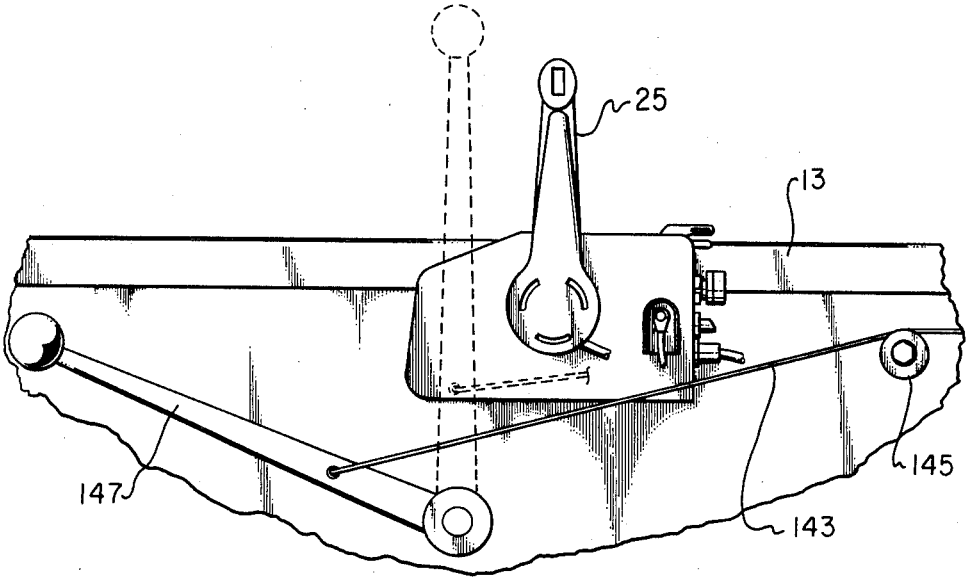
FIG. 7 is a schematic closeup view of the control lever for the raising and lowering apparatus of FIG. 1*a*.
Figure 6:
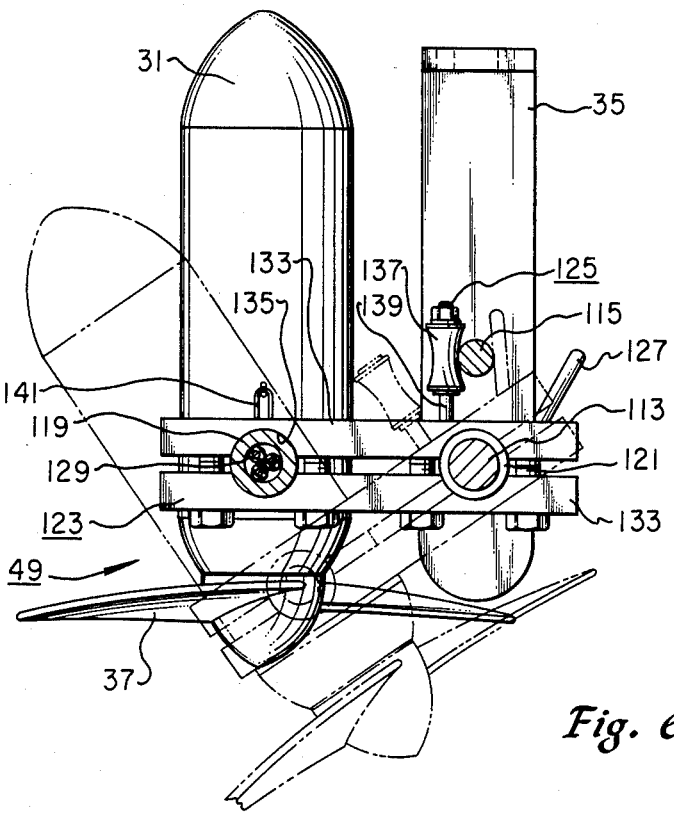
FIG. 6 is a schematic horizontal section view of the motor and steering means of FIG. 5, taken at lines VI—VI.

Referring to FIGS. 5 and 6, the steering means, in accordance with the swing arm embodiment will now be described. The steering means couples the trolling motors 31, 33 to the mounting portions. For each mounting portion there are two mounting brackets 35, an upper bracket and a lower bracket, which are connected together by a pivot rod 113 and an alignment rod 115. The pivot rod 113 is parallel to the alignment rod 115. The inner ends of the mounting brackets are bent toward each other for mounting onto the transom 22. Mounting the brackets to the hull is facilitated by bolt holes 117.

In the swing arm embodiment, the steering means for each trolling motor includes a shaft 119, a sleeve 121, a swing arm 123, alignment means 125, and stop means 127. The shaft 119 has two ends, an upper end and a lower end. The lower end is connected to the upper portion of the trolling motor 31 in a watertight manner. The shaft is hollow thereby allowing the passage of electrical conductors 129 from the steering cam assembly 45 to the trolling motor 31. The upper end of the shaft 119 is sealed with silcone 131 to insure the watertight integrity of the shaft. The nylon sleeve 121 is fitted around the pivot rod 113 to both slide along and rotate around the pivot rod. The swing arm 123 includes two rectangular plates 133 of equal dimensions. The rectangular plates have an inner surface and an outer surface. Two parallel channels 135, which are respectively shaped to conform to fit around portions of the shaft 119 and the sleeve 121, are cut across the minor dimension of the inside surface and near the ends of each plate. The two plates 133 are bolted together to form the swing arm 123 such that the upper end portion of the shaft 119 and the sleeve 121 are held firmly in place in the channels 135 and the shaft and the sleeve are unable to rotate independently of the swing arm.

The swing arm 123 allows changes in the orientation of the trolling motor 31 by having the trolling motor swing along a circular arc such that the longitudinal axis of the trolling motor is kept tangential to the arc. The change in orientation is precipitated by the amount and direction of thrust provided by the trolling motor 31.

The alignment means 125 aligns the trolling motor in an aligned position whenever the trolling motor produces forward thrust. The trolling motor 31 is in the aligned position when the longitudinal axis of the trolling motor is parallel to the boat keel. In the swing arm embodiment, the alignment means includes a concave roller 137 mounted on a pin 139 that extends perpendicularly from the forwardmost swing arm plate 133 and engages the alignment rod 115 whenever the trolling motor is in the alignment position. The concave roller 137 is located on the trolling motor side of the alignment rod 115.

The stop means 127 prevents the trolling motor 31 from swinging past a predetermined position whenever the trolling motor produces zero thrust or reverse thrust. In the swing arm embodiment, the stop means includes a pin 127 that protrudes at about a 45° angle from the forwardmost swing arm plate 133. The stop pin is located on the plate so as to contact the alignment rod 115 when the longitudinal axis of the trolling motor is about 45° from the boat keel.

There is also provided a means for raising and lowering the trolling motors, between a submerged position and an unsubmerged position by remote methods which will now be described (see FIGS. 1*a*, 1*b*, 5–7). On the forwardmost plate 133 of the swing arm is an eye 141, to which a cable 143 is attached. The cable 143 traverses upwardly through a series of pulleys 145, joins a second cable from the starboard swing arm, and finally connects to a control lever 147 located to the right of the driver's seat 23. As the control lever 147 is moved forward, the cable 143 tension tightens and simultaneously raises the two swing arms and trolling motors 31, 33 to an unsubmerged position. The sleeves 121 allow the swing arms 125 to travel along the pivot rods 113. As the control lever 147 is moved aft, the cable slackens and the trolling motors 31, 33 are lowered to a submerged position. The control lever 147 is positioned relative to the main motor throttle 25 such that when the control lever is in the aft position, the throttle is prevented from going forward. This mechanical lockout prevents the operation of the main motor while the trolling motors are lowered, and thus minimizes damages to the trolling motors.

The operation of the swing arm embodiment of the present invention will now be described. The steering cam assembly 45 is positioned in a convenient location on the boat so that a boat operator can steer the boat by operating the actuating means. Since the steering cam assembly 45 may be actuated with the foot, a convenient location is likely to be on the boat deck 15, just in front of the bow fishing seat 17 (see FIG. 1*b*). After the trolling motors 31, 33 have been lowered by the control lever 147, the boat 11 is propelled by the forward thrust of the trolling motors in a straight forwardly direction whenever the steering cam 53 is positioned as shown in FIG. 4 and the three position switch 111 is set to "ON". When the boat operator wants to make a shallow left hand turn, he places his foot on the top plate 47 and rotates the top plate counterclockwise for a short distance. As the top plate 47 and the steering cam 53 rotate, the roller for the right hand magnitude switch package 85 will follow the adjacent transitional surface 75 to the magnitude control surface 79 and the actuating arm 93 will allow the button 97 to release, whereupon the battery 39 will be disconnected from the left hand trolling motor 31. The left hand trolling motor 31 immediately stops producing forward thrust and assumes the condition of producing zero thrust. In this inactive state, the left hand trolling motor 31 acts to produce drag. The drag swings the left hand trolling motor 31 to a position where the longitudinal axis of the trolling motor is no longer parallel to the keel of the boat (see FIG. 6), thus further increasing drag. This position is determined by the stop pin 127 which contacts the alignment rod 115. All during this short period of time, the right hand trolling motor 33 continues to produce forward thrust. The drag of the left hand trolling motor on the left hand portion of the stern causes the bow of the boat to swing to the left. When the boat has turned sufficiently far enough to the left, the boat operator can simply remove his foot from the top plate 47 and the steering cam 53 will be returned, by the spring 109, to the preactuation position. The battery supply is reconnected to the left hand trolling motor in this steering cam position. The left hand trolling motor commences producing forward thrust and swings itself back into alignment with the boat keel. Any trolling motor realignment overshoot is eliminated by the concave roller 137 contacting the alignment rod 115.

The boat operator can obtain a sharper turn to the left by rotating the top plate 47 counterclockwise to the maximum extent. The steering cam housing peg 107 in the steering cam groove 105 determines the maximum extent of rotation. The initial sequence of events is the same as for a shallow turn; the battery 39 is disconnected from the left hand trolling motor 31. However, as the steering cam 53 continues to rotate, the roller for the right hand polarity switch package 83 will follow the adjacent transitional surface to the polarity control surface 77. The switches inside of the polarity switch package 83 reverse the polarity of the battery supply 39 as applied to the left hand trolling motor 31. As the steering cam 53 completes its rotation, the roller for the right hand magnitude switch package 85 follows the other transitional surface onto the third circumferential surface 73. The battery 39 is once again connected to the left hand trolling motor 31 but with reverse polarity. This has the effect of producing reverse thrust which quickens the left turn. Allowing the steering cam 53 to return to its preactuation position causes the left hand trolling motor 31 to produce forward thrust, after a brief period of time of producing zero thrust to change back to the original polarity.

The previously described embodiment of the electrical switching means has great utility for small trolling motors. For trolling motors having current ratings in excess of 10 amperes, an alternate embodiment of the electrical switching means is provided to protect the switching packages 83, 85 from overcurrent conditions (see FIG. 8). Electrical connections between the battery supply 39, the three position switch 111, and the magnitude switch packages 85 are the same as described above. However, the magnitude switch package first contacts 87 are connected to the polarity switch package commcn contacts 89. The polarity switch package first contacts 90 are connected to the coil of a first relay 149 and the polarity switch package second contacts 91 are connected to a coil of a second relay 151. The relay coils control double-pole, double-throw switches which are connected in parallel to one another between a heavy duty battery supply 153 and the trolling motors 31, 33. The double-pole, double-throw switches of the first and second relays are connected across the heavy duty battery supply 153 in such a manner that the battery supply polarity obtained by the left hand trolling motor 31 through the first relay 149 is reversed from the battery supply polarity obtained through the second relay 151.

Figure 8:
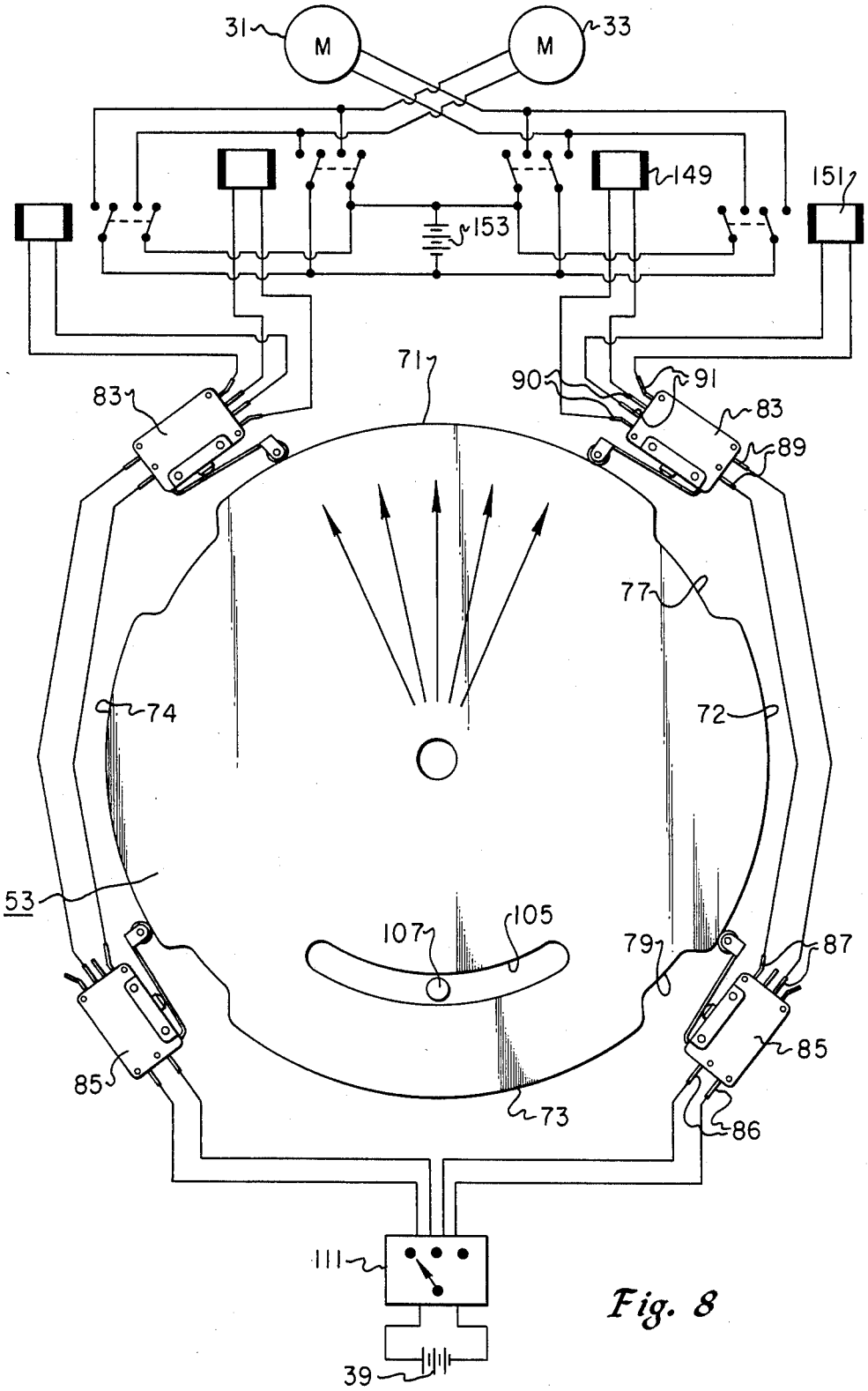
FIG. 8 is an electrical schematic view of the steering control system of the present invention, in accordance with another preferred embodiment.

The operation of the steering control system of the present invention, in accordance with the embodiment illustrated in FIG. 8, is, from the boat operators point of view, the same as the operation of the previously described embodiments of FIG. 4. Electrically, however, the polarity switch packages 83 and the magnitude switch packages 85 no longer directly control the trolling motors 31, 33. Instead, control is indirectly provided through the relays 149, 151. When the right hand magnitude switch package 85 is actuated for a shallow left turn, the battery supply 39 is disconnected from the coil of the first relay 149, thus disconnecting heavy duty battery supply 153 from the left hand trolling motor 31. For a sharper left turn, the right hand polarity switch package 83 is actuated after the battery supply 39 is disconnected through the right hand magnitude switch package 85. When the battery supply 39 is again reconnected by the right hand magnitude switch package 85, because the roller is now contacting the third circumferential surface 73, the right hand polarity switch package 83 energizes the coil of the second relay 151 which connects the heavy duty battery supply 153 to the left hand trolling motor 31 but with a reversed polarity. The left hand trolling motor is mounted to the boat 11 via the swing arm 123 and performs as previously described.

Figure 10:
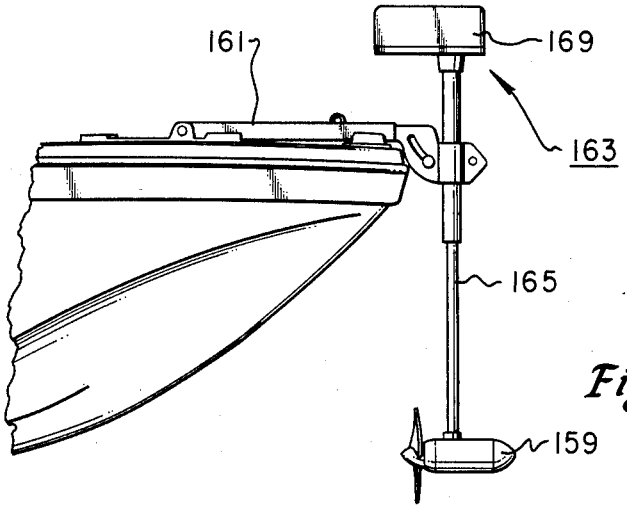
FIG. 10 is a schematic side view of a portion of a boat bow showing a trolling motor and steering mechanism of the steering control system of FIG. 9.

In another alternative embodiment, hereinafter referred to as the motorized embodiment, the steering control system of the present invention has, instead of two transom-mounted trolling motors, a single trolling motor 159 mounted on the bow portion 19 of the boat by a conventional mounting bracket 161 (see FIG. 10). The motorized embodiment includes a steering cam assembly, actuating means, and steering means 163 for changing the orientation of the trolling motor relative to the boat hull.

Figure 11:
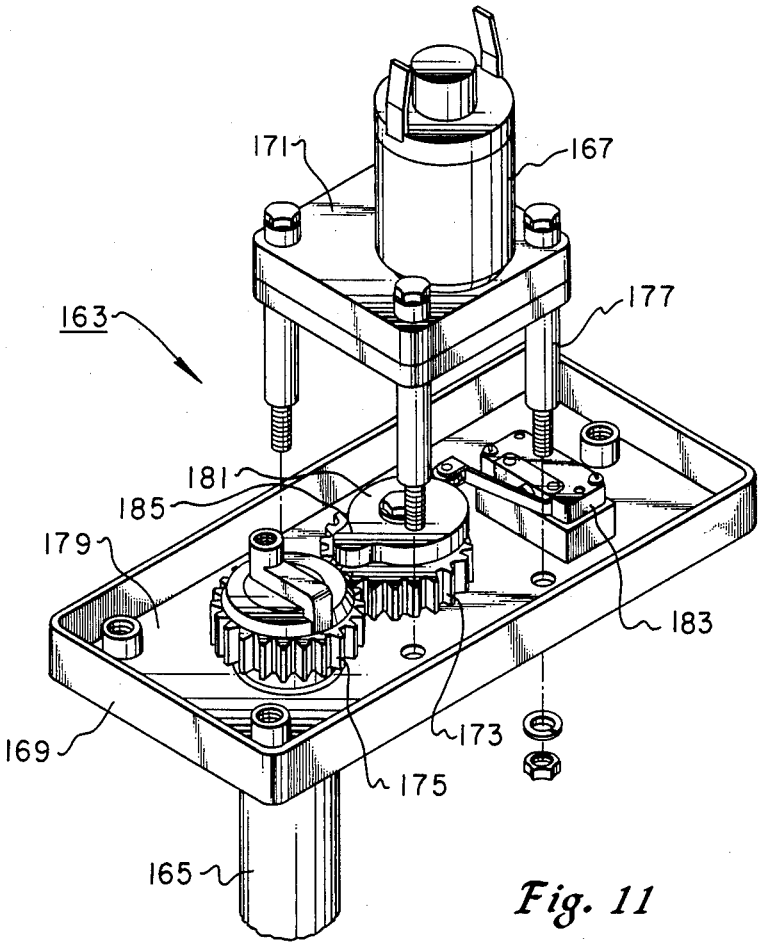
FIG. 11 is a schematic isometric exploded view of the steering means of FIG. 10.

The steering means 163, in the motorized embodiment, includes a shaft 165, a steering motor 167, drive means, and limit means (see FIG. 11). The trolling motor 159 depends from the shaft 165, which is mounted to the boat by the mounting bracket 161. The shaft 165 is free to rotate about its longitudinal axis independently of the mounting bracket 161. Furthermore, the shaft 165 is hollow to allow the passage of the electrical conductors (not shown) down to the trolling motor 159. At the upper end portion of the shaft is a small motor housing 169 that contains the steering motor 167, the drive means, and the limit means. The steering motor is a small conventional electric motor. The drive means includes a speed reducer box 171, a drive gear 173 and a driven gear 175. The input of the speed reducer box 171 is coupled to the output of the steering motor 167, the drive gear 173 is coupled to the output of the speed reducer 171, and the driven gear 175 meshes with the drive gear 173. The speed reducer box 171 is physically supported over the drive gear by four legs 177. The drive gear 173 is fixed to the motor housing floor 179 by conventional means. The driven gear 175 is unitary with the upper end portion of the shaft 165 as it protrudes slightly from the motor housing floor 179; therefore, whenever the driven gear is rotated, the shaft is also rotated.

The limit means for limiting the rotational distance of said shaft to a predetermined angular range includes a small limit cam 181 and a limit switch package 183. Circular in shape with a single saliency 185, the limit cam 181 is affixed to the upper surface of the drive gear 173 so as to turn unitarily with the drive gear. Adjacent to the limit cam 181 is the limit switch package 183. The limit switch package is of a type similar to the polarity switch packages 83 and the magnitude switch packages 85 of the swing arm embodiment. The limit switch package roller 187 rests on the circumference of the limit cam.

Figure 9:
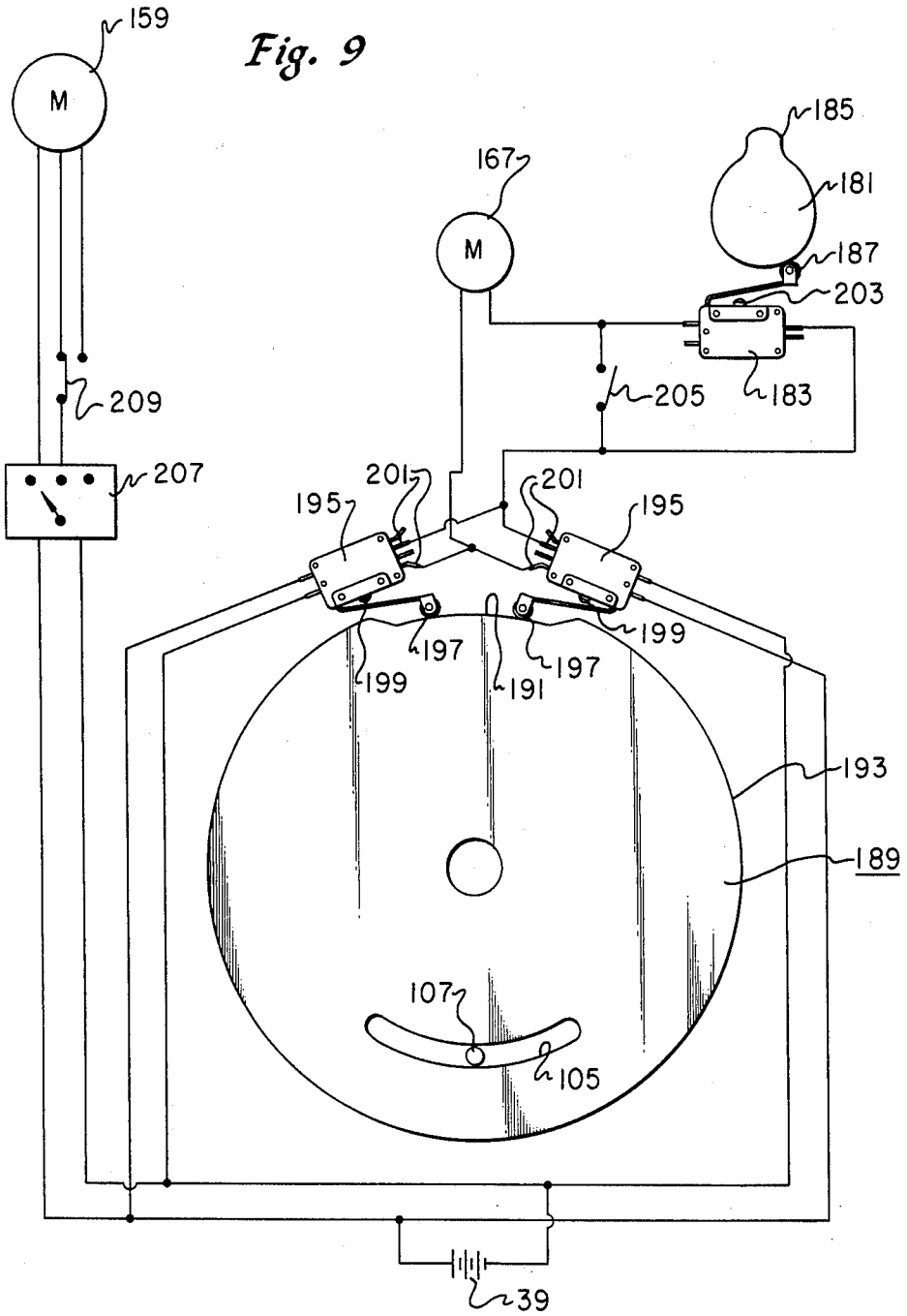
FIG. 9 is an electrical schematic view of a steering control system of the present invention, in accordance with another preferred embodiment.

The steering cam assembly for the motorized embodiment is much the same as for the swing arm embodiment, except for the actuating surfaces of the steering cam and the electrical switching means (see FIG. 9). The steering cam 189 has only a single indentation, the surface of which is the polarity control surface 191. A circumferential surface 198 is connected to the ends of the polarity control suface 191 by transitional surfaces. Polarity switch packages 195, similar to the polarity switch packages 83 of the swing arm embodiment are positioned relative to the steering cam 189 such that both rollers 197 contact the polarity control surface 191 when the steering cam is positioned to steer the boat in a straight direction. The polarity switch packages 195 are placed at a distance from the steering cam 189 such that when the rollers 197 contact the polarity control surface 191, the buttons 199 are released and when the rollers contact the circumferential surface 193, the buttons are depressed.

The electrical configuration of the motorized embodiment is somewhat different from the electrical configuration of the swing arm embodiment since the switch packages 195 do not control the trolling motor 159, but instead control the steering motor 167. The battery supply 39 is connected to both of the polarity switch packages 195. The output of the polarity switch packages are taken from the set of contacts that are normally open while the buttons are released. These output contacts 201 are connected to the steering motor such that each switch package supplies a different polarity. Because the outputs 201 of the polarity switch packages are connected together, care should be taken to avoid short circuiting the battery supply 39. One solution is to prevent the steering cam 189 from rotating any distance great enough to cause both of the polarity switch package rollers 197 to contact the circumferential surface 193 and therefore close all of the switches. This situation is prevented by appropriately sizing the arcuate length of the steering cam groove 105. The limit switch package 183 is connected in series between the steering motor 167 and the output contacts 201 of the polarity switch packages. The limit switch package 183 acts as a normally closed switch when the button 203 is released. A normally open reset switch 205 is connected in parallel with the limit switch 183. The trolling motor 159 is connected directly to the battery supply 39 via a three position switch 207 and a high speed/low speed switch 209.

The operation of the motorized embodiment will now be described. The direction of the boat is determined by the direction of the thrust provided by the trolling motor 159. As the longitudinal axis of the trolling motor 159 deviates from an alignment parallel to the boat keel, so to will the boat deviate from a straight heading. To effect a left turn, the steering cam 189 is rotated counterclockwise. This causes the right hand polarity switch package roller 197 to contact the circumferential surface 193 and connect the battery supply 39 to the steering motor 167 by closing the switches. The steering motor 167 rotates the shaft 165 and the trolling motor 159 counterclockwise. The resulting change in the direction of thrust pulls the bow to the left. When the desired heading is achieved, the steering cam 189 is rotated clockwise a sufficient distance to actuate the left hand polarity switch package 195. Reverse polarity is applied to the steering motor 167 which rotates the shaft and the trolling motor 159 clockwise. The steering cam 189 is returned to its original preactuation position when the trolling motor is once again aligned with the boat keel.

If the steering cam 189 is actuated for any significant period of time, the steering motor will continue to rotate the trolling motor 159. To prevent the electrical conductors inside of the shaft 165 from twisting, the limit cam 181 prevents the trolling motor from turning a complete circle. The limit cam 181 actuates the limit switch 183 located inside of the limit switch package and thereby opens the circuit to stop the steering motor. Operation is restored by manually depressing the reset switch 205 until the limit switch is deactuated.

Figure 12:
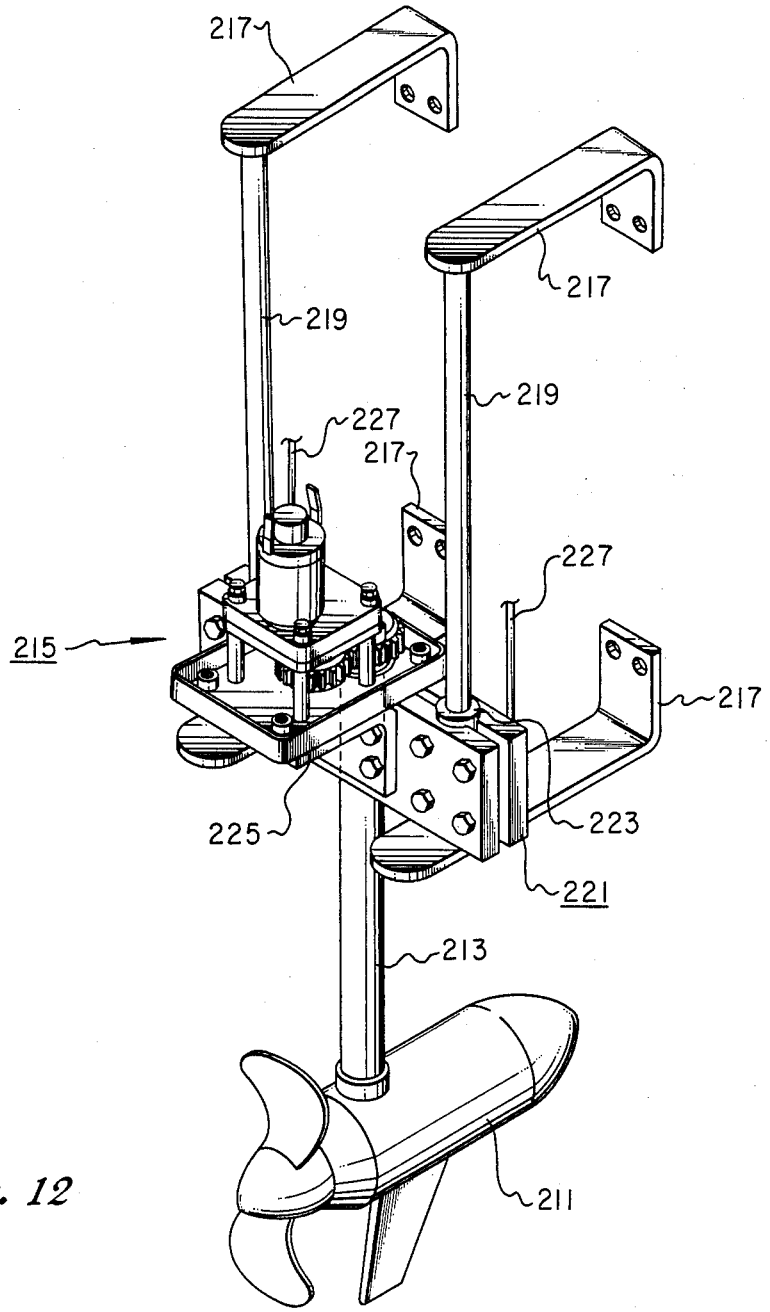
FIG. 12 is a schematic isometric view of a trolling motor and a steering mechanism. of FIG. 10, for installation onto the stern of a boat.

Although the motorized embodiment of the steering control system has been described with reference to a single bow mounted trolling motor, it is clear that the motorized embodiment can be utilized with transom-mounted motors. Referring to FIG. 12, one such embodiment is shown. The trolling motor 211, shaft 213, and steering means 215 are similar to those used by the bow mounted embodiment. The difference lies in the mounting brackets 217 which incorporate two parallel rods 219 for raising and lowering the trolling motor 211 and an arm 221 that is firmly secured to the two sleeves 223 placed around the respective rods. The steering means 215 is supported on the arm 221 by an angle bracket 225. The shaft 213 from which the trolling motor 211 depends is also supported by the arm 221, but in such a manner that allows the shaft to rotate about its longitudinal axis. Two cables 227 assist in raising and lowering the trolling motor. Two trolling motors, each supported by the embodiment illustrated in FIG. 12 may be utilized on the stern of the boat, with one trolling motor on each side of the keel. The steering cam assembly controls both of the steering motors simultaneously.

Further considerations concerning the present invention will now be discussed. Although the steering control system has been described with respect to fishing boats having a secondary propulsion means, the steering control system of the present invention can obviously be used on other types of watercraft. In addition, the steering control system of the present invention can be applied to a watercraft's primary propulsion means.

The steering cam assembly is entirely portable and may be moved from place to place around the boat. The limits of portability are determined only by the length of electrical wire that connects the steering cam assembly to the remainder of the steering control system. In use, the steering cam assembly is stationarily positioned relative to the boat hull so that as the top plate is rotated, the steering cam housing remains stationary. This positioning is easily achieved by placing the steering cam assembly on the boat deck so that the bottom plate contacts the deck. Alternatively, the steering cam assembly could be placed on the boat deck so that the top plate contacts the deck.

The actuating means has been described in the preferred embodiments as a top plate. Alternative acuating means include a steering wheel or a chair which rotates the steering cam as the chair itself is rotated. In the case where the steering cam assembly is placed upon the deck with the top plate contacting the deck, the actuating means is the steering cam housing.

The foregoing disclosure and the showings made in the drawings are merely illustrative of the principles of this invention and are not to be interpreted in a limiting sense.

What is claimed is:

1. A steering control system for a boat propelled by electrical propulsion means, said propulsion means comprising at least one submergible portion for providing propulsive thrust along the longitudinal axis of said submergible portion and a mounting portion for mounting said submergible portion to said boat, said submergible portion having a streamlined shape so as to present a minimal amount of resistance to water flowing past said submergible portion, said boat also having means for energizing electrical systems on said boat, including said propulsion means and said steering control system, said steering control system comprising:

a. A steering cam assembly stationarily positioned relative to the hull of said boat comprising:
   i. a first member having actuating surfaces forming varying contours,
   ii. a second member positioned relative to said first member such that said first and second members rotate relative to each other,
   iii. electrical switching means fixedly coupled to said second member and adjacent said first member actuating surfaces, having actuating portions responsive to the relative rotational movement of said actuating surfaces, whereby said means for energizing the steering control system is controlled by the actuation of the switching means, b. actuating means for imparting relative rotational movement between said first member and said second member, c. said steering cam assembly positioned in a convenient location on said boat so that a boat operator can steer said boat by operating said actuating means, d. steering means for changing the orientation of said submergible portion relative to the hull of said boat, said submergible portion orientation changing responsive to the relative rotational movement between said first and second members and the actuation of said switching means.

2. The steering control system of claim 1 wherein said propulsion means comprises at least two submergible portions and associated mounting portions for mounting said submergible portions onto the transom of said boat such that there are an equal number of submergible portions on each side of the boat keel.

3. The steering control system of claim 2 wherein:

a. said steering control system and said propulsion means are energized by the same source, b. said switching means selectively controls the magnitude of the thrust output of said respective submergible portions by controlling the magnitude of the energy supplied to said propulsion means by said means for energizing said propulsion means.

4. The steering control system of claim 3 wherein said steering means for each submergible portion further comprises:

a. a shaft having two ends, one end of which is coupled to said submergible portion, b. an arm having two ends, one end portion of which is coupled to the other end of said shaft, the other arm end portion being swingably coupled to said respective mounting portion, c. alignment means for aligning said submergible portion relative to the keel of said boat whenever said submergible portion produces forward thrust, whereby when said submergible portion is in an aligned position the longitudinal axis of the submergible portion is parallel to the keel of said boat, d. wherein said steering means allows changes in the orientation of said submergible portion by having said submergible portion swing along a circular arc from the aligned position to a non-aligned position according to the thrust output of said submergible portion, whereby the longitudinal axis of said submergible portion is kept tangential to the arc.

5. The steering control system of claim 4 wherein said steering means further comprises stop means for preventing said individual submergible portions from swinging past a predetermined position whenever said individual submergible portions produce zero thrust or reverse thrust.

6. The steering control system of claim 5 wherein said switching means selectively controls the direction of thrust output along the longitudinal axis of said respective submergible portions by controlling the polarity of the energy supplied to said propulsion means by said means for energizing said propulsion means.

7. The steering control system of claim 3 wherein said switching means selectively controls the direction of thrust output along the longitudinal axis of said respective submergible portions by controlling the polarity of the energy supplied to said propulsion means by said means for energizing said propulsion means.

8. The steering control system of claim 2 wherein said steering means selectively changes the orientation of each of said submergible portions by rotating said submergible portion.

9. The steering control system of claim 8 wherein:

a. said steering means for each submergible portion further comprises:

i. a shaft having two ends, one end of which is coupled to said submergible portion, ii. drive means coupled to the other end of said shaft for rotating said shaft about its longitudinal axis, iii. a steering motor coupled to said drive means, the rotational direction of said steering motor being responsive to polarity changes of the energy supplied to said steering motor by said means for energizing said steering control system, b. said switching means selectively controls the respective steering motors by controlling the magnitude and polarity of the energy supplied to said steering motors by said means for energizing said steering control system.

10. The steering control system of claim 9 wherein said steering means further comprises means for limiting the rotational distance said shaft traverses to a predetermined angular range.

11. The steering control system of claim 2 wherein said steering control system further comprises remote means disposed adjacent a driver's position in said boat for raising and lowering said submergible portions between a submerged position and an unsubmerged position, wherein said submergible portions may be raised or lowered from a location which is remote from said submergible portions.

12. The steering control system of claim 1 wherein said steering means changes the orientation of said submergible portion by rotating said submergible portion.

13. The steering control system of claim 12 wherein:

a. said steering means for said submergible portion further comprises:

i. a shaft having two ends, one end of which is coupled to said submergible portion, ii. drive means coupled to the other end of said shaft for rotating said shaft about its longitudinal axis, iii. a steering motor coupled to said drive means, the rotational direction of said steering motor being responsive to polarity changes of the energy supplied to said steering motor by said means for energizing said steering control system, b. said switching means selectively controls the steering motor by controlling the magnitude and polarity of the energy supplied to said steering motor by said means for energizing said steering control system.

14. The steering control system of claim 13 wherein said steering means futher comprises means for limiting the rotational distance of said shaft to a predetermined angular range.

15. The steering control system of claim 1 wherein said steering cam assembly further comprises:

a. means for limiting the relative rotational distance traversed between said first member and said second member to a predetermined angular range, b. means for realigning said first member relative to said second member to a preactuation alignment, after the actuation of said actuating means.

* * * * *